US005756447A

United States Patent [19]

Hall

[11] Patent Number: 5,756,447

[45] Date of Patent: May 26, 1998

[54] DISPENSING AGENT

[75] Inventor: Robin Gibson Hall, Birmingham, United Kingdom

[73] Assignee: The Procter & Gamble Company, Cincinnati, Ohio

[21] Appl. No.: 770,130

[22] Filed: Dec. 19, 1996

Related U.S. Application Data

[63] Continuation of Ser. No. 454,335, filed as PCT/US93/12090 Dec. 13, 1993, abandoned.

[30] Foreign Application Priority Data

Dec. 24, 1992 [GB] United Kingdom ..... 9226942

[51] Int. Cl.[6] ..... C11D 3/37

[52] U.S. Cl. ..... 510/475; 510/478; 510/480; 510/349; 510/360; 510/361; 510/442; 510/443; 510/444

[58] Field of Search ..... 510/399, 360, 510/361, 442, 443, 444, 478, 480, 475

[56] References Cited

U.S. PATENT DOCUMENTS

| | | | |
|---|---|---|---|
| H1514 | 1/1996 | Williman et al. | 252/547 |
| 4,356,109 | 10/1982 | Saeki et al. | 252/316 |
| 4,414,130 | 11/1983 | Cheng | 252/140 |
| 4,566,980 | 1/1986 | Smith | 252/8.6 |
| 4,587,033 | 5/1986 | Dyroff et al. | 524/405 |
| 5,266,237 | 11/1993 | Freeman et al. | 252/542 |
| 5,328,610 | 7/1994 | Sikes | 424/401 |
| 5,328,631 | 7/1994 | Du Vosel et al. | 252/174.23 |
| 5,520,842 | 5/1996 | Punce et al. | 252/174.24 |
| 5,534,182 | 7/1996 | Kirk et al. | 8/137 |
| 5,538,671 | 7/1996 | Morrall | 510/476 |
| 5,540,863 | 7/1996 | Wood et al. | 510/356 |

FOREIGN PATENT DOCUMENTS 0454126 10/1991 European Pat. Off. .

*Primary Examiner*—Jacqueline V. Howard
*Attorney, Agent, or Firm*—Ken K. Patel; Kim W. Zerby; Jacobus C. Rasser

[57] ABSTRACT

A cleaning composition contains (a) a detersive surfactant and (b) a poly(amino acid) compound or a precursor thereof, the said component (b) being protected from contact with a level of alkalinity as would cause degradation thereof. The component (b) may be stabilized by, for example, coating it with an organic acid compound or with a film-forming polymer; by agglomerating it with a controlled level of alkaline or alkaline-reacting compound (e.g. sodium carbonate); by spray-granulating it in admixture with a nonionic surfactant; by encapsulating it with a silicone-based resin; or by incorporating it in a composition that is non-alkaline. The storage stability of the compositions is thereby improved.

19 Claims, No Drawings

DISPENSING AGENT

This is a continuation of application Ser. No. 08/454,335, filed Jun. 16, 1995, now abandoned which is a 371 of PCT/US93/1290, filed Dec. 13, 1993.

FIELD OF THE INVENTION

The present invention relates to the use of poly(amino acids) and derivatives thereof as dispersing agents, especially in cleaning compositions, for example in laundry detergent compositions.

BACKGROUND TO THE INVENTION

Polyacrylates and acrylate/maleate copolymers are widely used as dispersing agents, specifically as soil-suspending and/or anti-redeposition agents, in detergent compositions and confer important cleaning benefits thereon. However, these polymers and copolymers are not readily biodegradable, thereby posing potential environmental problems. Carboxymethyl cellulose is biodegradable at a degreeof substitution (DS) of less than 0.7 but, although it confers some whiteness-maintenance benefit to detergent compositions, it is deficient with regard to soil-suspension properties.

In EP-A-0,454,126, it is disclosed that certain poly(amino acids) and derivatives thereof can be used as builders or co-builders in the formulation of detergent compositions. The said polymers, especially those derived from aspartic acid, glutamic acid and mixtures thereof, are described as effective agents for the complexing of calcium and for preventing the formation of calcium carbonate crystals. The said polymers are stated to have further advantages, in that they are resistant to heat, stable to pH, non-toxic, non-irritant and entirely biodegradable.

However, research by the present Applicant has revealed that polyaspartate or other salts of poly(amino acids) incorporated in a granular detergent composition will degrade over a period of time, especially under conditions of elevated temperature and/or high humidity (e.g. conditions of 90° F. (32.2° C.) and 80% relative humidity), such as are typical of Southern European and other Mediterranean countries (and which may obtain even in warehouses elsewhere). Such degradation, which is irreversible, may give rise to a significant loss in dispersant activity within the storage periods (typically up to 8 weeks) that may occur in practice. This degradation was unexpected in view of the relative strength of the amide linkages present in poly(amino acids).

SUMMARY OF THE INVENTION

The present invention provides a cleaning composition containing a poly(amino acid) compound or a precursor thereof and a detersive surfactant, characterised in that the poly(amino acid) compound or precursor thereof is protected from contact with a level of alkalinity as would cause degradation thereof.

The present invention also provides a poly(amino acid) compound or a precursor thereof, characterised in that it is provided with a coating, is encapsulated or is mixed, in the form of an agglomerate or granulate, with at least one other material.

The present invention also provides a poly(amino acid) compound or a precursor thereof, characterised in that it is in the form of an agglomerate with an alkaline or alkaline-reacting material.

The present invention further provides a process for producing a poly(amino acid) compound in the form of an agglomerate suitable for incorporation into a cleaning composition, which comprises agglomerating the alkaline or alkaline-reacting material with a compound that is converted into the poly(amino acid) compound in alkaline conditions, the agglomeration being effected in the presence of sufficient moisture for the conversion into the poly(amino acid) compound to proceed.

DESCRIPTION OF EXEMPLARY EMBODIMENTS

The expression "poly(amino acid)" compound includes herein not only a poly(amino acid) as such but also a derivative thereof, such as an amide, an ester or a salt. The poly(amino acid) may be a homopolymer or may be copolymer of two or more amino acids. The amino acid may be a D-amino acid, an L-amino acid or a mixture, e.g. a racemic mixture, thereof. The amino acids include, for instance, alanine, glycine, tyrosine, serine and lysine, although glutamic, carboxyglutamic and aspartic acids are preferred. Of these, aspartic acid is particularly preferred. Normally, for the purposes of formulating a cleaning composition, in particular a laundry detergent composition, the poly(amino acid) will be used in the form of a salt thereof, preferably an alkali metal salt and more preferably the sodium salt.

It will be understood that the poly(amino acid) compound may be constituted by a mixture of two or more compounds of the appropriate description.

Also contemplated herein is the use of a precursor of a poly(amino acid) compound, suitable precursors being compounds that will undergo conversion into a poly(amino acid) or derivative thereof when exposed to alkaline conditions. Thus, a preferred precursor herein is polysuccinimide, which hydrolyses to polyaspartic acid at a pH greater than 9, the hydrolysis being particularly rapid at pH values of 10 or higher. This opens up the possibility of forming the poly (amino acid) or derivative thereof in situ in the wash liquor formed by the addition of the laundry detergent or other cleaning composition to water; such wash liquors typically have a pH value of 10.5 or thereabouts.

The molecular weight of the poly(amino acid) compound or its precursor may be varied within wide limits. Preferably, the molecular weight is from 500 to 200,000, more preferably 2000 to 20,000.

According to the present invention, a poly(amino acid) compound or precursor thereof is stabilised against degradation sufficiently to render it acceptably storage-stable. This is effected, in particular, by protecting the said compound or precursor from contact with a level of alkalinity as would cause unacceptable degradation thereof. The stabilisation or protection should be such that the amount of degradation of the poly(amino acid) compound or precursor thereof is less than 50% over an 8 week storage period under stressed conditions (90° F.(32.2° C.) and 80% relative humidity), preferably less than 30% and most preferably less than 5%.

A preferred method for stabilising the poly(amino acid) compound against degradation is to apply a stabilising coating thereon. The coating material, which should be compatible with other components of the cleaning composition, may be selected from a wide variety of biodegradable and non-biodegradable compounds. Of course, the coating may comprise a mixture of two or more suitable materials.

In certain preferred embodiments, the coating material is an organic acid compound, in particular such a compound that is solid at ambient temperatures; thus, the organic compounds should in general have a melting point of at least 30° C. and will preferably have a melting point of at least 40° C. and, more preferably, a melting point in excess of 50° C. The organic acid compound should also be highly soluble in water at ambient temperatures, "highly soluble" being defined for the purposes of the present invention as at least 5 g of the acid dissolving in 100 g of distilled water at 20° C. Preferably, the organic acid compound has a solubility of at least 20 g/100 g of water at 20° C. and most preferably the organic acid compound will dissolve in its own weight of water at 20° C.

Organic acid compounds suitable as coating agents for the purposes of the present invention include aliphatic or aromatic, monomeric or oligomeric carboxylic acids, preferably the monomeric aliphatic carboxylic acids. Examples of such aliphatic acid compounds are glycolic, glutamic, succinic, 1-lactic, malonic, glutaric, adipic, maleic, malic, tartaric, diglycolic, carboxymethyl succinic, citric, citraconic, itaconic and mesaconic acids; and copolymers formed from an unsaturated polycarboxylic acid (e.g. maleic, citraconic, itaconic or mesaconic acid) as one monomer and an unsaturated monocarboxylic acid such as acrylic acid or an alpha-$C_1$–$C_4$ alkyl acrylic acid as the second monomer, suitable copolymers being available from BASF under the trade names Sokalan® CP5 and CP45.

The organic acid compound may be used in admixture with another material suitable for use in the cleaning composition: thus, for example, a coating which will impart an acid environment around the poly(amino acid) compound may comprise citric acid or the like dissolved in a nonionic surfactant. The use of gelatine as an admixture is also possible. The use of a coating of a poly(amino acid) to protect a poly(amino acid) derivative also comes into consideration.

The acids are applied at levels of, in general, from 2% to 20% by weight of the coated substrate, preferably from 2% to 15%, more preferably from 3% to 12% and most preferably from 3% to 10% by weight of the coated substrate. Glycolic acid at a level of approximately 5% by weight of the coated substrate is a particularly preferred coating agent.

The organic acid compound may be sprayed on as a molten material or as a solution or dispersion in a solvent/carrier liquid which is subsequently removed by evaporation. The organic acid compound can also be applied as a powder coating although this is less preferred as the provision of a uniform layer of coating material is less easy and therefore less effective.

Molten coating is a preferred technique for organic acid compounds of melting point less than 80° C., such as glycolic and 1-lactic acids, but is less convenient for higher melting point acids (e.g. higher than 100° C.) such as citric acid. For organic acid compounds of melting point higher than 80° C. spraying-on as a solution or dispersion is preferred. Organic solvents such as ethyl and isopropyl alcohol can be used to form the solutions or dispersions, although this will necessitate a solvent recovery stage in order to make their use economic. However, the use of organic solvents also gives rise to safety problems such as flammability and operator safety and thus aqueous solutions or dispersions are preferred.

Aqueous solutions are particularly advantageous where the organic acid compound has a high aqueous solubility (e.g. citric acid) and the solution has a sufficiently low viscosity to enable it to be handled. Preferably a lo concentration of at least 25% by weight of the organic acid compound in the solvent is used in order to reduce the drying/evaporation load after coating has taken place. The coating apparatus can be any of those normally used for this purpose, such as inclined rotary pans, rotary drums and fluidised beds.

The poly(amino acid) compound may alternatively be stabilised by means of a coating formed from a water-soluble film-forming polymer. Such polymers include water-soluble cellulose ethers, for example methyl cellulose, ethyl cellulose, hydroxyethyl cellulose, methyl hydroxyethyl cellulose, methyl hydroxypropyl cellulose, carboxymethyl cellulose (in particular as the sodium salt) and methylcarboxy methyl cellulose (in particular as the sodium salt); water-soluble starches, for example maize starch or depolymerised starch; starch ethers, for example carboxymethyl starch, hydroxyethyl starch and methyl starch; and mixtures of any two or more of these. Sodium carboxymethyl cellulose (CMC) is preferred.

Suitable film-forming polymers also include homopolymers or copolymers of carboxylic acids, such as polyacrylic acid, polymethacrylic acid and polymaleic acid; copolymers of acrylic acid or methacrylic acid with maleic acid, or a copolymer of maleic acid with vinylmethyl ether; and the salts, in particular the sodium salts, of such polymeric acids. Preferred film-forming agents from this group are sodium polyacrylate and the sodium salts of acrylic acid/maleic acid copolymers with a weight ratio of acrylic acid: maleic acid of 10:1 to 1:1, preferably 7:1 to 2:1. These compounds may have a molecular weight of 3000 to 150,000, preferably 5000 to 10,000.

A further class of film-forming polymers are the carbon-chain polymers with nonionic hydrophilic groups as well as polyether groups, examples of which include polyvinyl alcohol, partially saponified polyvinyl acetate, polyvinyl pyrrolidone, polyacrylamide and polyethylene glycol ether.

Suitable mixtures of film-forming polymers include, for example, a mixture of CMC or methyl cellulose with polyacrylate or with an acrylic/maleic acid copolymer, or a mixture of polyethylene glycol ether with polyacrylate or an acrylic acid/maleic acid copolymer.

Another, and particularly preferred, method of stabilising the poly(amino acid) compound is to formulate it as an agglomerate with an alkaline or alkaline-reacting compound. An alkali as such, e.g. sodium or potassium hydroxide, although not precluded, may not be suitable for many cleaning compositions and it is preferred to use an alkaline salt, for example a carbonate, bicarbonate or silicate. Preferred salts are the alkali metal salts, especially sodium salts. Naturally, a mixture of two or more alkaline or alkaline-reacting compounds may be used. Moreover, the alkaline or alkaline-reacting compound may be used in admixture with one or more other suitable materials, for example an anionic surfactant such as alkyl ethoxy sulfonate (AES).

Bearing in mind that polyaspartate or the like is susceptible to alkaline hydrolysis, it is particularly surprising that poly(amino acid) compounds can be rendered storage-stable by agglomerating them with an alkaline or alkaline-reacting compound. However, in accordance with one aspect of this invention, the degradation of the poly(amino acid) compound can be inhibited by controlling the level of alkaline or alkaline-reactive compound in the agglomerate: in certain preferred embodiments, there is no more than 1 mole of alkaline or alkaline-reacting compound per mole of monomeric unit in the poly(amino acid) compound.

In a preferred embodiment of this invention, the alkaline or alkaline-reacting compound is mixed initially with a precursor of the poly(amino acid) compound, in particular such a precursor that converts into a poly(amino acid) compound under alkaline conditions. The agglomeration stage is normally effected in the presence of sufficient water to allow such conversion to take place and, even after drying, the agglomerates will normally contain sufficient residual moisture to permit the conversion to proceed to completion if it has not already done so by then. Suitable precursors are, for example, the imides of those poly(amino acids) that form such imides. Thus, storage-stable poly (aspartic acid) or a salt thereof, in particular sodium polyaspartate, can be readily prepared by agglomerating polysuccinimide with an alkaline or alkaline-reacting compound, the polysuccinimide being converted into the polyaspartic acid or polyaspartate in situ. This method is particularly advantageous in that the polysuccinimide is markedly cheaper than the commercially available polyaspartate and yet this method provides the latter compound in a storage-stable form that is suitable for incorporation into a granular (which term includes pulverulent) cleaning composition, for example a laundry detergent composition.

The preferred alkaline or alkaline-reacting material is sodium carbonate, which salt is a worthwhile component in cleaning compositions in its own right, since it acts as an effective dissolution aid. Normally, the carbonate is included in laundry detergent compositions in the form of a micronized powder; however, the use of carbonate having a larger particle size, or carbonates having different particle sizes, comes into consideration, since this will reduce the surface area per unit mass and thereby will reduce the rate of reaction between the poly(amino acid) compound and the carbonate.

In certain preferred embodiments there is no more than 1 mole of alkaline or alkaline-reacting compound, e.g. carbonate, per mole of monomeric unit in the precursor, e.g. the succinimide moiety in polysuccinimide.

Another preferred embodiment consists in forming agglomerates from polyaspartic acid (or other poly(amino acid)) and sufficient carbonate (or other alkaline or alkaline reacting compound) to effect neutralisation but not degradation. The poly(amino acid) may be formed in situ from a suitable precursor, e.g. polysuccinimide. Other components may, of course, be included in such agglomerates.

The agglomeration of the poly(amino acid) compound, or its precursor, and the alkaline or alkaline-reacting compound may be carried out using any suitable agglomeration technique and apparatus, if appropriate with compatible agglomeration auxiliaries. Such techniques, apparatus and auxiliaries are well-known in the detergent-formulating art. Once the agglomerates are formed, they may be dried, if required, by conventional means.

Agglomeration of the poly(amino acid) compound or precursor thereof can be conveniently carried out in various types of high-shear mixers, for example a Z-blade mixer, an Eirich mixer or a Lödige mixer.

The agglomerates according to this invention may contain, for example, the following: 20–40% of anionic surfactant, 0–30% of sodium carbonate, 0–50% of zeolite, 0–15% of the poly(amino acid) compound or precursor thereof, 0–10% of CMC, with the balance being water. In a typical procedure the agglomeration mixer is charged with the inorganic materials and the CMC, together with the poly(amino acid) compound or precursor thereof, the resultant mixture being agglomerated with a high-active anionic surfactant (typically from 50–85% active by weight), suitable anionic surfactants being, for example, C45AS, LAS or TAS. Typically, the paste addition is effected at 50–80° C. and the agglomeration time will typically be from 1 to 15 minutes. The agglomeration may be followed by an optional drying and cooling step. Typical physical properties of the resultant agglomerates are a density in the range of 500–900 g/l, a mean particle size of 200–800 μm, a corresponding low cake strength and good free-flowing properties.

It is, of course, also possible to agglomerate the poly (amino acid) compound with a non-alkaline material, e.g. a nonionic surfactant, zeolite, bicarbonate, or a mixture of two or more of these and/or other non-alkaline materials. A suitable agglomerate is essentially non-alkaline, and contains a poly(amino acid) or precursor thereof.

A further method according to this invention of stabilising the poly(amino acid) compound is to spray-granulate it in admixture with, for example, a nonionic surfactant. Yet another method according to the invention is to encapsulate the poly(amino acid) compound, for example using a silicone-based resin.

Yet another method of stabilising the poly(amino acid) compound against alkaline hydrolysis and hence degradation consists in incorporating the said compound as a dispersing agent in a cleaning composition, in particular a laundry detergent composition, that is so formulated as to be essentially neutral in terms of its pH. In this embodiment, the detergent matrix itself is acting, as it were, as the stabilising medium and it is not therefore necessary to coat, agglomerate, spray-granulate or encapsulate the dispersing agent as described above, although this is not precluded. A suitable cleaning composition is non-alkaline and contains a poly(amino acid) or precursor thereof.

Pretreatment of the poly(amino acid) compound or precursor thereof may be carried out if appropriate. For example, the said compound or precursor may be premixed with a surfactant paste prior to agglomeration, coating, spray-granulating, encapsulation or the like, or it may be mixed in the form of an aqueous solution with the surfactant, followed by drying to remove moisture. The latter procedure permits a predetermined moisture level to be achieved.

By suitable adjustment of the pretreatment, e.g. via premixing of the poly(amino acid) compound or a precursor thereof with surfactant paste, it is possible to obtain agglomerates containing an excess of carbonate or other alkaline or alkaline-reacting compound.

As demonstrated in Example 2 hereinafter, degradation of a poly(amino acid) compound may also be caused by the presence of a bleach, in particular a source of hydrogen peroxide. Accordingly, it is a further aspect of this invention to provide a cleaning composition containing a poly(amino acid) compound or a precursor thereof and a detersive surfactant, characterised in that the poly(amino acid) compound or precursor thereof is protected from contact with a level of bleach as would cause degradation thereof. The poly(amino acid) compound or its precursor may be stabilised or protected against unacceptable degradation (as defined above) by coating, by encapsulation or by mixing, in the form of an agglomerate or granulate, with at least one other material, by means analogous to those described above. In certain preferred embodiments, the poly(amino acid) compound or precursor thereof is included in a detergent or other cleaning composition that contains no, or substantially no, bleach; in such a case, depending upon the level of alkaline or alkaline-reacting material, it may not be necessary to further stabilise the poly(amino acid) compound or its precursor by means of coating, encapsulation, agglomerating, granulating or the like, although this is not precluded.

The stabilised poly(aspartic acid) compound according to the present invention may be used as a dispersing agent (which term herein includes a clay-soil-suspending agent and/or an anti-redeposition agent) in solid (e.g. granular or other particulate) cleaning compositions and will generally be employed therein at a level of from 0.1% to 50%, usually at least 0.4%, preferably 1 to 15%, more preferably 2.5 to 10% and most preferably 3 to 6%, by weight. The cleaning compositions will generally contain one or more detersive surfactants, the total amount of such surfactant being in general up to 70%, typically 1% to 50%, preferably 1 to 30%, more preferably 5 to 25% and especially 10 to 20%, by weight of the total composition.

Although the poly(amino acid) compound may be included in a wide variety of cleaning compositions, for example hard-surface and other household cleaners and dishwashing compositions, they are particularly suitable for use in laundry detergent compositions, e.g. general-purpose or heavy-duty granular laundry detergent compositions. These will contain not only the stabilised poly(amino acid) compound dispersing agent and detersive surfactant but also, optionally, one or more further components conventional in the art; these may be selected from, for example, a detergent builder, a bleach (in particular a source of hydrogen peroxide, e.g. sodium perborate or sodium percarbonate), a bleach activator (e.g. TAED), an enzyme, a polymeric soil-release agent, a chelating agent, a conventional dispersing agent, a brightener, a suds suppressor, a pH-buffering agent, a dye, a dye transfer inhibition agent or a pigment. It will be understood that any of the above-mentioned components, whether essential or optional, may be constituted, if desired, by a mixture of two or more compounds of the appropriate description.

A wide range of surfactants can be used in the cleaning compositions. A typical listing of anionic, nonionic, ampholytic and zwitterionic classes, and species of these surfactants, is given in U.S. Pat. No. 3,664,961 issued to Norris on May 23, 1972.

Mixtures of anionic surfactants are particularly suitable herein, especially mixtures of sulfonate and sulfate surfactants in a weight ratio of from 5:1 to 1:2, preferably from 3:1 to 2:3, more preferably from 3:1 to 1:1. Preferred sulfonates include alkyl benzene sulfonates having from 9 to 15, especially 11 to 13, carbon atoms in the alkyl radical, and alpha-sulphonated methyl fatty acid esters in which the fatty acid is derived from a $C_{12}$–$C_{18}$ fatty source, preferably from a $C_{16}$–$C_{18}$ fatty source. In each instance the cation is, in general, an alkali metal, preferably sodium. Preferred sulfate surfactants are alkyl sulfates having from 12 to 16 carbon atoms in the alkyl radical, optionally in admixture with ethoxy sulfates having from 10 to 20, preferably 10 to 16, carbon atoms in the alkyl radical and an average degree of ethoxylation of 1 to 6. Examples of preferred alkyl sulfates are tallow alkyl sulfate, coconut alkyl sulfate, and $C_{14-15}$ alkyl sulfates. The cation in each instance is again, in general, an alkali metal cation, preferably sodium.

One class of nonionic surfactants particularly useful in the present invention are condensates of ethylene oxide, with a hydrophobic moiety to provide a surfactant having an average hydrophilic-lipophilic balance (HLB) in the range from 5 to 17, preferably from 6 to 14, more preferably from 7 to 12. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol, the $C_{12}$–$C_{15}$ primary alcohols containing 3–5 moles of ethylene oxide per mole of alcohol, and mixtures thereof.

Another suitable class of nonionic surfactants comprising alkyl polyglucoside compounds of general formula $$RO(C_nH_{2n}O)_tZ_x$$

wherein Z is moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergents are disclosed in EP-A-0,070,077, EP-A-0,075,996 and EP-A-0,094,118.

Also suitable as nonionic surfactants are poly hydroxy fatty acid amide surfactants of the formula $$R^2-\underset{\underset{O}{\|}}{C}-\underset{\underset{R^1}{|}}{N}-Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

A further class of surfactants are the semi-polar surfactants such as amine oxides. Suitable amine oxides are selected from mono $C_8$–$C_{20}$, preferably $C_{10}$–$C_{14}$, N-alkyl or alkenyl amine oxides and propylene-1,3-diamine dioxides wherein the remaining N positions are substituted by methyl, hydroxyethyl or hydroxypropyl groups.

Another class of surfactants are amphoteric surfactants, such as polyamine-based species.

Cationic surfactants can also be used in the detergent compositions herein and suitable quaternary ammonium surfactants are selected from mono $C_8$–$C_{16}$, preferably $C_{10}$–$C_{14}$, N-alkyl or alkenyl ammonium surfactants wherein the remaining N positions are substituted by methyl, hydroxyethyl or hydroxypropyl groups.

Mixtures of surfactant types are preferred, more especially anionic-nonionic and also anionic-nonionic-cationic mixtures. Particularly preferred mixtures are described in GB-A-2,040,987 and EP-A-0,087,914.

Builder materials will typically be present at from 5% to 60% of the cleaning compositions herein. The compositions herein preferably are free or substantially free of phosphate-containing builders (substantially free being herein defined to constitute less than 1% of the total detergent builder system), and the builder system herein consists of water-soluble builders, water-insoluble builders, or mixtures thereof.

Water-insoluble builders can be an inorganic ion-exchange material, commonly an inorganic hydrated aluminosilicate material, more particularly a hydrated synthetic zeolite such as hydrated Zeolite A, X, B or HS.

Preferred aluminosilicate ion-exchange materials have the unit cell formula $$M_z[(AlO_2)_z(SiO_2)_y]\ xH_2O$$

wherein M is a calcium-exchange cation, z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 18% to 22%, water.

The above aluminosilicate ion exchange materials may be further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope. The aluminosilicate ion exchange materials may be further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein may be still further characterised by their calcium ion exchange rate which is described in detail in GB-A-1,429 143.

Aluminosilicate ion-exchange materials useful in the practice of this invention are commercially available and can be naturally occurring materials, but are preferably synthetically derived. A method for producing aluminosilicate ion exchange materials is discussed in U.S. Pat. No. 3,985,669. Preferred synthetic crystalline aluminosilicate ion exchange materials useful herein are available under the designation Zeolite A, Zeolite B, Zeolite X, Zeolite HS and mixtures thereof. In an especially preferred embodiment, the crystalline aluminosilicate ion exchange material is Zeolite A and has the formula $$Na_{12}[(AlO_2)_{12}(SiO_2)_{12}]\ xH_2O$$

wherein x is from 20 to 30, especially 27. Zeolite X of formula $Na_{86}[(AlO_2)_{86}(SiO_2)_{106}]-10\ .276H_2O$ is also suitable, as well as Zeolite HS of formula $Na_6[(AlO_2)_6(SiO_2)_6]7.5\ H_2O$).

Another suitable water-soluble, inorganic builder material is layered silicate, e.g. SKS-6 (Hoechst). SKS-6 is a crystalline layered silicate consisting of sodium silicate ($Na_2Si_2O_5$). The high $Ca^{++}/Mg^{++}$binding capacity is mainly a cation exchange mechanism. In hot water, the material becomes more soluble.

The water-soluble builder can be a monomeric or oligomeric carboxylate chelating agent.

Suitable carboxylates containing one carboxy group include lactic acid, glycollic acid and ether derivatives thereof as disclosed in BE-A-831,368, BE-A-821,369 and BE-A-821,370. Polycarboxylates containing two carboxy groups include the water-soluble salts of succinic acid, malonic acid, (ethylenedioxy) diacetic acid, maleic acid, diglycollic acid, tartartic acid, tartronic acid and fumaric acid, as well as the ether carboxylates described in DE-A-2,446,686, DE-A-2,446,687 and U.S. Pat. No. 3,935,257, and the sulfinyl carboxylates described in BE-A-840,623. Polycarboxylates containing three carboxy groups include, in particular, water-soluble citrates, aconitrates and citraconates as well as succinate derivatives such as the carboxymethyloxysuccinates described in GB-A-1,379,241, lactoxysuccinates described in Netherlands Patent Application 7205873, and the oxypolycarboxylate materials such as 2-oxa-1,1,3-propane tricarboxylates described in GB-A-1,387,447.

Polycarboxylates containing four carboxy groups include oxydisuccinates disclosed in GB-A-1,261,829, 1,1,2,2-ethane tetracarboxylates, 1,1,3,3-propane tetracarboxylates and 1,1,2,3,-propane tetracarboxylates. Polycarboxylates containing sulfo substituents include the sulfosuccinate derivatives disclosed in GB-A-1,398,421 and GB-A-1,398,422 and in U.S. Pat. No. 3,936,448, and the sulfonated pyrolysed citrates described in GB-A-1,082,179, while polycarboxylates containing phosphone substituents are disclosed in GB-A-1,439,000.

Alicyclic and heterocyclic polycarboxylates include cyclopentane-cis, cis, cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in GB-A-1,425,343.

Of the above, the preferred polycarboxylates are hydroxycarboxylates containing up to three carboxy groups per molecule, more particularly citrates.

Preferred builder systems for use in the preferred granular detergent compositions herein include a mixture of a water-insoluble aluminosilicate builder such as zeolite A, and a water-soluble carboxylate chelating agent such as citric acid.

Other builder materials that can form part of the builder system include inorganic materials such as alkali metal carbonates, bicarbonates, silicates and organic phosphonates, amino polyalkylene phosphonates and amino polycarboxylates.

The cleaning compositions or detergent additives herein may contain a further soil antiredeposition or soil-suspension agent, in addition to the poly(amino acid) compounds herein. Such antiredeposition and soil-suspension agents suitable herein include cellulose derivatives such as methylcellulose, carboxymethylcellulose and hydroxycellulose, homo- or co-polymeric polycarboxylic acids or their salts and polyamino compounds. Polymers of this type include the polyacrylates and maleic anhydride-acrylic acid copolymers disclosed in detail in EP-A-0,137,669, as well as copolymers of maleic anhydride with ethylene, methyvinyl ether or methacrylic acid, the maleic anhydride constituting at least 20 mole percent of the copolymer. These materials are normally used at levels of from 0.025% to 5% by weight, of the compositions herein.

EP-A-311,342 discloses certain modified polyesters which act as soil-release agents on polyester fabrics; these modified polyesters also come into consideration herein.

The cleaning compositions, in particular the detergent compositions, are preferably in granular form and more preferably in a "compact" form, i.e. having a density, which is higher than the density of conventional detergent compositions. The preferred density of the compositions herein ranges from 550 to 950 g/litre, preferably 650 to 850 g/litre of composition, measured at 20° C.

The present invention is illustrated in and by the following examples.

EXAMPLE 1

Three formulations containing sodium polyaspartate were prepared, having the composition:

| | |
|---|---|
| LAS | 9.52 parts by weight |
| TAS | 0.49 |
| 25E3 | 3.26 |
| TAE11 | 1.11 |
| Zeolite A | 19.5 |
| Citrate | 6.56 |
| Polyaspartate, sodium | 3.19 |
| Silicate (2.0 ratio) | 3.5 |
| Carbonate | 14.52 |
| TAED | 5.0 |
| Perborate | 16.0 |
| DETPMP | 0.38 |
| $M_gSO_4$ | 0.40 |
| Enzyme | 1.4 |
| CMC | 0.48 |
| Brightener | 0.24 |
| Photobleach | 0.002 |
| Suds suppressor | 0.54 |
| Perfume | 0.43 |

The first formulation contained the polyaspartate added directly by dry addition. The second formulation contained the polyaspartate added in the form of an agglomerate with sodium zeolite, sodium carbonate, anionic surfactant and CMC. The third formulation contained the polyaspartate added in the form of an agglomerate with sodium zeolite, anionic surfactant and CMC (i.e. with no carbonate).

The agglomerates added to the second and third compositions had the following, respective, constituents

| | Second | Third |
|---|---|---|
| Anionic surfactant | 31 | 31 |
| Carbonate | 21 | 0 |
| Zeolite | 28 | 40 |
| Polyaspartate | 10 | 10 |
| CMC | 1 | 1 |

Each of the three formulations was placed in a respective, standard cardboard detergent carton and left open to the atmosphere under conditions of stress storage (90° F. (32.2° C.) and 80% relative humidity) for a period of 8 weeks. Samples of each formulation were removed after given intervals of time during that storage period and were analysed by both quantitative and qualitative methods, using the standard analytical technique of capillary zone electrophoresis (CZE) and also by a standard detergent formulation performance test method.

CZE traces (electropherograms) were taken on samples of each of the three formulations removed from the respective stored products after intervals of 2, 4, 6 and 8 weeks. A reference sample of polyaspartate that had not been subjected to storage was also analysed by CZE. The electropherograms showed degradation of the polyaspartate over the storage period in the cases of the first formulation (direct addition of polyaspartate) and the second formulation (addition by means of agglomerates containing carbonate).

From both the qualitative and quantitative analysis of the polyaspartate performance over the 8-week storage period, it could be concluded that the polyaspartate is degraded when exposed to high levels of alkalinity.

EXAMPLE 2

Tests were carried out in order to ascertain which of the detergent components were responsible for the degradation of polyaspartate.

A series of open-top, plastics beakers (500 ml capacity) were prepared, each containing sodium polyaspartate and one of the following components: (a) sodium zeolite, (b) sodium percarbonate plus TAED, (c) sodium perborate tetrahydrate plus TAED, (d) a proteolytic enzyme and (e) sodium carbonate.

The amounts used in the beakers were as follows (% by weight)

| | a | d | e | b/c |
|---|---|---|---|---|
| Zeolite | 80% | 65% | 55% | 35% |
| Carbonate | — | — | 25% | — |
| Enzyme | — | 15% | — | — |
| Powdered polyaspartate | 20% | 20% | 20% | 20% |
| Bleach/TAED | — | — | — | 30/15% |

The beakers were subjected, with their tops left open, to conditions of stress storage (90° F. (32.2° C.); 80% relative humidity). The polyaspartate content in each case was quantitatively analysed by CZE and the results showed that there was no significant degradation in the case of the composition (d) containing the enzyme and only a low level of degradation in the composition (a) containing the zeolite (such minimal degradation being, it is thought, due to trace alkalinity in the zeolite material); there was, however, substantial degradation of the polyaspartate in the compositions (b) and (c) containing a bleach and a bleach activator, and substantial degradation also occurred in the composition (e) containing the carbonate.

EXAMPLE 3

A series of compositions were prepared in the form of agglomerates, each containing four parts by weight of polysuccinimide and, respectively, 0, 1, 2, 3, 4, 5, or 10 parts by weight of sodium carbonate. The agglomerates were added to respective samples of a conventional laundry detergent matrix containing surfactant, builder, bleach, chelant, enzyme and such minor ingredients as perfume and colouring matter. The agglomerates were added at a level customary for the addition of dispersant to laundry detergent compositions.

The resultant dispersant-containing compositions were maintained over an 8-week storage period under conditions of stress storage. During that period samples were analysed quantitatively using CZE.

The CZE traces indicated that, where the level of carbonate was less than or equal to equimolar with respect to the monomeric units in the polysuccinimide, the latter had been converted partially or wholly into polyaspartate but that no significant degradation of the latter occurred over the test period. (In the experiment in which carbonate was absent there was no conversion of the polysuccinimide into polyaspartatic acid.) In contrast, where the level of carbonate was in excess of equimolar with respect to the monomeric units in the polysuccinimide, the latter had been converted into polyaspartate but this had in turn, undergone significant degradation; indeed, in the composition containing an extremely high level (10 parts) of carbonate, complete degradation of the polyaspartate had occurred within two weeks.

EXAMPLE 4

The following laundry detergent products can be prepared (amounts are in parts by weight) using polyaspartic acid, its sodium salt or polysuccinimide as the dispersant.

| | A | B | C | D |
|---|---|---|---|---|
| LAS | 7.71 | 7.71 | 7.71 | 7.71 |
| TAS | 2.43 | 2.43 | 2.43 | 2.43 |
| TAE11 | 1.10 | 1.10 | 1.10 | 1.10 |
| 25E3 | 3.26 | 3.26 | 3.26 | 3.26 |
| Zeolite A | 19.5 | 19.5 | 19.5 | 19.5 |
| Citrate | 6.5 | 6.5 | 6.5 | 6.5 |
| Dispersant | 4.25 | 4.25 | 4.25 | 4.25 |
| Carbonate | 11.14 | 11.14 | 11.14 | 11.14 |
| Perborate | 16.0 | 16.0 | 16.0 | 16.0 |
| TAED | 5.0 | 5.0 | 5.0 | 5.0 |
| EDTA | 0.38 | — | — | — |
| DETPMP | — | 0.38 | — | — |
| EDDS | — | — | 0.38 | 0.22 |
| CMC | 0.48 | 0.48 | 0.48 | 0.48 |
| Suds Suppressor | 0.5 | 0.5 | 0.5 | 0.5 |
| Brightener | 0.24 | 0.24 | 0.24 | 0.24 |
| Photoactivated bleach | 0.002 | 0.002 | 0.002 | 0.002 |
| Enzyme | 1.4 | 1.4 | 1.4 | 1.4 |
| Silicate (2.0 ratio) | 4.38 | 4.38 | 4.38 | 4.38 |
| $MgSO_4$ | 0.43 | 0.43 | 0.43 | 0.43 |
| Perfume | 0.43 | 0.43 | 0.43 | 0.43 |
| Sulphate | 4.10 | 4.10 | 4.10 | 4.10 |

Water and miscellaneous to balance

It will of course be understood that the present invention has been described above purely by way of example and that modifications of detail can be made within the scope of the invention.

In the detergent compositions, the abbreviated component identifications have the following meanings:

| | |
|---|---|
| LAS | Sodium liner $C_{12}$ alkyl benzene sulphonate |
| TAS | Sodium tallow alcohol sulfate |
| $TAE_n$ | Tallow alcohol ethoxylated with n moles of ethylene oxide per mole of alcohol |
| 25E3 | A $C_{12-15}$ primary alcohol condensed with an average of 3 moles of ethylene oxide |
| TAED | Tetraacetyl ethylene diamine |
| Silicate | Amorphous Sodium Silicate ($SiO_2$:$Na_2O$ ratio normally follows) |
| Carbonate | Anhydrous sodium carbonate |
| CMC | Sodium carboxymethyl cellulose |
| Zeolite A | Hydrated Sodium Aluminosilicate of formula $Na_{12}(AlO_2SiO_2)_{12}.27H_2O$ having a primary particle size in the range from 1 to 10 micrometers |
| Citrate | Tri-sodium citrate dihydrate |
| Photobleach | Tetra sulfonated Zinc phthalocyanine |
| MA/AA | Copolymer of 1:4 maleic/acrylic acid, average molecular weight about 80,000 |
| Enzyme | Mixed proteolytic and amylolytic enzyme sold by Novo Industries AS |
| Brightener | Disodium 4,4'-bis(2-morpholino-4-anilino-s-triazin-6-ylamino) stilbene-2:2'-disulphonate |
| DETPMP | Diethylene triamine penta (Methylene phosphonic acid), marketed by Monsanto under the Trade name Dequest 2060 |
| Mixed Suds Suppressor | 25% paraffin wax Mpt 50° C., 17% hydrophobic silica, 58% paraffin oil |

I claim:

1. A cleaning composition comprising:

(a) detersive surfactant and (b) poly(amino acid) compound or precursor thereof protected from contact with a degradation-causing level of alkalinity:

wherein the poly(amino acid) compound or precursor is in a form selected from the group consisting of:

poly(amino acid) compounds or precursors coated with an additional carboxylic acid compound, a water-soluble polymer capable of forming a film, or mixtures thereof;

poly(amino acid) compounds or precursors agglomerated with an alkaline compound, an alkaline-reacting compound, or mixtures thereof, wherein the alkaline compound, alkaline-reacting compound, or mixture thereof is present in an amount that is equimolar or less with respect to the poly(amino acid) constituent monomer units or precursor thereof;

poly(amino acid) compounds or precursors spray-granulated in admixture with nonionic surfactant, wherein the nonionic surfactant comprises the detersive surfactant component (a) or a surfactant other than the detersive surfactant component (a); and poly(amino acid) compounds or precursors encapsulated with silicone resin.

2. A composition according to claim 1 in which the alkaline-reacting compound is a salt selected from the group consisting of carbonates, bicarbonates, silicates and mixtures thereof.

3. A composition according to claim 1 in which the poly(amino acid) compound is selected from the group consisting of polyaspartic acid and salts thereof, polyglutamic acid and salts thereof, and mixtures thereof.

4. A composition comprising a poly(amino acid) compound or precursor coated with a carboxylic acid compound according to claim 1 wherein the carboxylic acid compound comprises a monomer, oligomer or copolymer of an aliphatic or aromatic carboxylic acid.

5. A composition according to claim 4 in which the carboxylic acid compound comprises a monomeric aliphatic carboxylic acid.

6. A composition comprising poly(amino acid) compound or precursor coated with a water-soluble polymer capable of forming a film according to claim 1 in which the water-soluble polymer is selected from the group consisting of cellulose ethers, starches, starch ethers, homopolymers of carboxylic acids and salts of such homopolymers, copolymers of carboxylic acids and salts of such copolymers, carbon-chain polymers having nonionic hydrophilic groups, and mixtures thereof.

7. A composition according to claim 1 in which the poly(amino acid) precursor is polysuccinimide.

8. A composition according to claim 1 further comprising at least one additional ingredient selected from the group consisting of builders, bleaches, bleach activators, enzymes, polymeric soil-releasing agents, chelating agents, brighteners, suds suppressors, pH-buffering agents, dyes, and dye transfer inhibition agents.

9. A composition according to claim 1 comprising 0.1 to 50% by weight of the composition of poly(amino acid) compound or precursor thereof, and up to 70% by weight of the composition of detersive surfactant.

10. A cleaning composition according to claim 1 which contains no bleach.

11. A non-alkaline cleaning composition comprising detersive surfactant and a poly(amino acid) compound or precursor.

12. A cleaning composition according to claim 11 which contains no bleach.

13. A poly(amino acid) compound or precursor thereof protected from contact with a degradation-causing level of alkalinity and selected from the group consisting of:

poly(amino acid) compounds or precursors coated with an additional carboxylic acid compound, a water-soluble polymer capable of forming a film, or mixtures thereof, poly(amino acid) compounds or precursors agglomerated with an alkaline compound, an alkaline-reacting compound, or mixtures thereof, wherein the alkaline compound, alkaline-reacting compound, or mixture thereof is present in an amount sufficient to effect complete neutralization of the poly(amino acid) compound or a precursor-derived poly(amino acid) compound, without causing degradation thereof;

poly(amino acid) compounds or precursors spray-granulated in admixture with nonionic surfactant wherein the nonionic surfactant can be the detersive surfactant of component (a) or an additional nonionic surfactant; and poly(amino acid) compounds or precursors encapsulated with silicone resin.

14. A process for producing a poly(amino acid) compound in the form of an agglomerate according to claim 13 comprising the steps of:

(a) mixing an alkaline compound, an alkaline-reacting compound, or mixture thereof with a precursor that is converted into the poly(amino acid) compound under alkaline conditions, and (b) agglomerating the alkaline compound, alkaline-reacting compound or mixture thereof and the precursor in the presence of sufficient moisture for the conversion to proceed, wherein the alkaline compound, alkaline-reacting compound, or mixture thereof is present in an amount sufficient to effect complete neutralization of the poly(amino acid) compound derived from its precursor without causing degradation thereof.

15. A process according to claim 14 in which the poly (amino acid) precursor is polysuccinimide.

16. An agglomerate of poly(amino acid) compound or precursor with alkaline-reacting compound according to claim 13.

17. An agglomerate according to claim 16 comprising an alkaline-reacting salt selected from the group consisting of carbonates, bicarbonates, and silicates.

18. An agglomerate according to claim 16 further comprising nonionic surfactant and zeolite.

19. A poly(amino acid) compound or precursor thereof protected from contact with a degradation-causing level of alkalinity by a stabilization method such that the amount of degradation of the poly(amino acid) compound or precursor thereof is less than 50% over an 8 week storage period under conditions of 32.2° C. and 80% relative humidity.

* * * * *